US006860801B2

(12) United States Patent
Yang et al.

(10) Patent No.: US 6,860,801 B2
(45) Date of Patent: Mar. 1, 2005

(54) PEDESTAL OF A LOAD-CUP WHICH SUPPORTS WAFERS LOADED/UNLOADED ONTO/FROM A CHEMICAL MECHANICAL POLISHING APPARATUS

(75) Inventors: Yun-sik Yang, Suwon (KR); Kyung-dae Kim, Suwon (KR); Hyung-sik Hong, Yongin (KR); Min-gyu Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 187 days.

(21) Appl. No.: 10/255,638

(22) Filed: Sep. 27, 2002

(65) Prior Publication Data

US 2003/0045219 A1 Mar. 6, 2003

Related U.S. Application Data

(62) Division of application No. 09/597,586, filed on Jun. 20, 2000, now Pat. No. 6,537,143.

(30) Foreign Application Priority Data

Jun. 22, 2000 (KR) ..... 99-23491

(51) Int. Cl.[7] ..... B24B 47/00

(52) U.S. Cl. ..... 451/388; 451/388; 451/285; 451/444

(58) Field of Search ..... 451/285, 289, 451/41, 444, 398, 388; 414/935, 944, 783; 294/64.1, 64.3; 269/21

(56) References Cited

U.S. PATENT DOCUMENTS 5,324,012 A * 6/1994 Aoyama et al. ..... 269/21
5,374,829 A * 12/1994 Sakamoto et al. ..... 250/453.11
5,738,574 A 4/1998 Tolles et al.
5,772,773 A 6/1998 Wytman
5,934,984 A 8/1999 Togawa et al.
6,193,807 B1 * 2/2001 Tateyama et al. ..... 134/2
6,227,950 B1 5/2001 Hempel et al.
6,241,592 B1 6/2001 Togawa et al.
6,257,564 B1 * 7/2001 Avneri et al. ..... 269/21
6,368,049 B1 4/2002 Osaka et al.

FOREIGN PATENT DOCUMENTS

JP 63-229732 * 9/1988 ..... 269/221
JP 2-26246 2/1990

* cited by examiner

*Primary Examiner*—George Nguyen
(74) *Attorney, Agent, or Firm*—Volentine Francos & Whitt, PLLC

(57) ABSTRACT

A pedestal of a load-cup for supporting wafers loaded onto and being unloaded from a chemical mechanical polishing (CMP) apparatus includes a pedestal plate, and a pedestal film which extends over only a limited area at the upper surface of the pedestal plate. This area includes the regions directly around the fluid ports provided in the pedestal plate for vacuum-chucking the wafers and spraying deionized water. The pedestal plate may have a cross-shaped part, the entirety of which bears the fluid ports. The pedestal film may include annular members each extending around only a respective one of the fluid ports, or one or more members each extending radially around several of the fluid ports. By offering a rather limited contact area to the wafer supported on the pedestal, the pedestal film reduces the amount of contaminants which could be transferred to the wafer surface in contact therewith.

4 Claims, 10 Drawing Sheets

PEDESTAL OF A LOAD-CUP WHICH SUPPORTS WAFERS LOADED/UNLOADED ONTO/FROM A CHEMICAL MECHANICAL POLISHING APPARATUS

CROSS-REFERENCE TO RELATED APPLICATIONS

A claim of priority is made as a Divisional of application Ser. No. 09/597,586, filed Jun. 20, 2000, now U.S. Pat. No. 6,537,143, which is incorporated herein by reference.

BACKGROUND OF THE INVENTION

1. Field of the Invention

The present invention relates to a load-cup which receives wafers as they are loaded onto and unloaded from a chemical mechanical polishing apparatus. More particularly, the present invention relates to the pedestal of such a load-cup.

2. Description of the Related Art

Increasing the integration of semiconductor devices has required sequentially depositing multiple layers on a wafer. Accordingly, the semiconductor manufacturing process must include steps for planarizing each layer formed on the semiconductor wafer. Chemical mechanical polishing (CMP) is a typical process used for this purpose. In fact, CMP is well-suited for use in connection with large-diameter wafers because CMP produces excellent uniformity in planarizing wide areas in addition to narrow ones.

The CMP process makes use of mechanical friction and a chemical agent for finely polishing a wafer surface, such as that comprising tungsten or an oxide. In the mechanical aspect of such polishing, a wafer is placed on a rotating polishing pad and is rotated while a predetermined is load applied thereto, whereby the wafer surface is polished by the friction created between the polishing pad and the wafer surface. In the chemical aspect of such polishing, the wafer surface is polished by a chemical polishing agent, referred to as slurry, supplied between the polishing pad and the wafer.

A conventional CMP apparatus will now be described with reference to FIGS. 1–6. As shown best in FIGS. 1 and 2, the conventional CMP apparatus includes a base 100, polishing pads 210*a*, 210*b* and 210*c* installed on the base 100, a load-cup 300 for loading/unloading wafers, and a head rotation unit 400 having a plurality of polishing heads 410*a*, 410*b*, 410*c* and 410*d* for holding the wafers and fixedly rotating the same on the polishing pads 210*a*, 210*b* and 210*c*.

In general, the CMP apparatus is provided with three polishing pads 210*a*, 210*b* and 210*c* so that a plurality of wafers can be processed in a short time. Each of the polishing pads 210*a*, 210*b* and 210*c* is closely fixed on a rotatable carousel (not shown). Pad conditioners 211*a*, 211*b* and 211*c* for controlling the surface states of the polishing pads 210*a*, 210*b* and 210*c* and slurry supplying arms 212*a*, 212*b* and 212*c* for supplying slurry to the surfaces of the polishing pads 210*a*, 210*b* and 210*c* are provided in the vicinity of the polishing pads 210*a*, 210*b* and 210*c*.

The load-cup 300 for wafer loading/unloading has a pedestal 310 having a circular-plate shape, on which the wafers are placed, installed therein. At the load-cup 300, as will be described later, washing of polishing heads 410*a*, 410*b*, 410*c* and 410*d* for holding wafers and the pedestal 310 is performed.

The head rotation unit 400 includes four polishing heads 410*a*, 410*b*, 410*c* and 410*d* and four rotation shafts 420*a*, 420*b*, 420*c* and 420*d*. The polishing heads 410*a*, 410*b*, 410*c* and 410*d* hold wafers and apply a predetermined pressure to the top faces of the polishing heads 410*a*, 410*b*, 410*c* and 410*d* for close fixation while polishing is performed. The rotation shafts 420*a*, 420*b*, 420*c* and 420*d* for rotating the polishing heads 410*a*, 410*b*, 410*c* and 410*d*, respectively, are mounted on a frame 401 of the head rotation unit 400. Within the frame 401 of the head rotation unit 400 a driving mechanism is provided for rotating the rotation shafts 420*a*, 420*b*, 420*c* and 420*d*. The head rotation unit 400 is supported by a pivot 402 and is installed to be rotatable around the pivot 402.

Also, the load-cup 300 includes a circular pedestal 310 on which the wafers are placed. The bottom surfaces of the polishing heads 410*a*, 410*b*, 410*c* and 410*d* and the top surface of the pedestal 310 are washed at the load-cup 300, as will be described later in more detail.

The head rotation unit 400 includes four polishing heads 410*a*, 410*b*, 410*c* and 410*d* and four rotation shafts 420*a*, 420*b*, 420*c* and 420*d*. The polishing heads 410*a*, 410*b*, 410*c* and 410*d* hold wafers and apply a predetermined amount of pressure to the top surfaces of the polishing pads 210*a*, 210*b*, 210*c* and 210*d*. The rotation shafts 420*a*, 420*b*, 420*c* and 420*d* for rotating the polishing heads 410*a*, 410*b*, 410*c* and 410*d*, respectively, are mounted on a frame 401 of the head rotation unit 400. A driving mechanism for rotating the rotation shafts 420*a*, 420*b*, 420*c* and 420*d* is provided within the frame 401 of the head rotation unit 400. The head rotation unit 400 is supported by a rotary bearing 402 so as to be rotatable about the longitudinal axis of the rotary bearing 402.

The process performed by the CMP apparatus having the above-described configuration will now be described with reference to FIGS. 1 and 2. First, a wafer 10 transferred to the load-cup 300 by a wafer transfer apparatus (not shown) is placed on the surface of the pedestal 310 of the load-cup 300. Here, the wafer 10 is adhered by suction to the surface of the pedestal 310 so as not to move. Then, the wafer 10 is lifted by the pedestal 310 onto a polishing head 410 positioned above the pedestal 310. The wafer 10 is adhered by suction to the polishing head 410. The head rotation unit 400 is rotated to transfer the wafer 10 in such a state above the polishing pad 210*a* adjacent to the load-cup 300. Then, the polishing head 410 is lowered to tightly press the wafer 10 onto the polishing pad 210*a*. At this time, the polishing pad 210*a* and the wafer 10 are rotated in the same direction while slurry is supplied therebetween, whereby the wafer 10 is polished. The wafer 10 is then transferred sequentially to the other polishing pads 210*b* and 210*c* and then to the load-cup 300 where it is placed on the pedestal 310. Thereafter, the wafer transfer apparatus transfers the wafer 10 placed on the pedestal 310 to a location outside the CMP apparatus.

Once the wafer 10 has been unloaded, the polishing head 410 descends towards the load-cup 300. In such a state, deionized water is sprayed to wash the bottom surface of the polishing head 410 and the top surface of the pedestal 310. When washing is completed, the polishing head 410 and the pedestal 310 are lifted again and a new wafer is transferred by the wafer transfer apparatus onto the pedestal 310.

FIGS. 3 and 4 are perspective views of the load-cup and pedestal, respectively, of the conventional CMP apparatus. FIG. 5 is a cross-sectional view of the load-cup with its pedestal, and FIG. 6 is an enlarged cross-sectional view of a peripheral portion of the pedestal shown in FIG. 5.

Referring to FIGS. 3 and 5, in order to wash the bottom surface of the polishing head 410 and the top surface of the pedestal 310, the load cup 300 is provided with washing means comprising a first nozzle 331 and a second nozzle 332 for spraying deionized water within a washing basin 320 of the load-cup 300. The first nozzle 331 is oriented so as to spray deionized water toward the top surface of the pedestal 310 and the second nozzle 332 is oriented so as to spray deionized water toward a membrane 411 installed on the bottom surface of the polishing head 410. The membrane 411 allows a vacuum to act on the wafers and secure them to the polishing head 410. Three sets each of the first and second nozzles 135 and 136 are installed at equal angular intervals around the circumference of the pedestal 310. Three wafer aligners 340 for guiding wafers are installed within the washing basin 320 of the load-cup 300 at equal angular intervals around the circumference of the pedestal 310 to guide the wafers placed on the pedestal 310 into position.

The washing basin 320 is supported by a cylindrical support housing 350, and a flexible hose 336 for supplying deionized water to the first and second nozzles 331 and 332 is installed within the support housing 350. A washing fluid channel 337 for connecting the flexible hose 336 to the first and second nozzles 331 and 332 is provided within the washing basin 320.

As best shown in FIG. 4, the pedestal 310 of the load-cup 300 includes a pedestal plate 311, a pedestal support column 312 and a thin pedestal film 313. The pedestal plate 311 serves to support wafers and is in turn supported by the pedestal support column 312. The conventional pedestal plate 311 is circular. The thin pedestal film 313 is adhered to the top surface of the pedestal plate 311 and directly contacts the wafer supported by the pedestal plate 311.

Referring to both FIGS. 4 and 5, a plurality of fluid ports 314 extend through the pedestal plate 311 to allow a wafer to be vacuum-chucked to the plate 311 and to allow deionized water to be sprayed from the plate 311. A vertical passageway 316 extends through the pedestal support column 312, and a lateral passageway 315 defined within the pedestal plate 311 connects the fluid ports 314 to the vertical passageway 316. The vertical passageway 316 and the lateral passageway 315 allow deionized water to be fed to the fluid ports 314 for washing the membrane 411 disposed at the bottom of the polishing head 410.

Therefore, as described above, the load-cup 300 is responsible for washing the bottom surface of the polishing head 410 and the top surface of the pedestal 310 as well as for supporting wafers while they are loaded and unloaded onto and from the CMP apparatus. The washing step is very important in the CMP process. Contaminants such as slurry debris or polished silicon particles are unavoidably produced during the CMP process, and some of the contaminants may remain on the surface of the membrane 411 and/or the pedestal 310. The contaminants remaining on the surface of the membrane 411 and/or the pedestal 310 can generate micro-scratches on the surface of a wafer if the contaminants are transferred thereto when the wafer is loaded in the course of polishing. The micro-scratches may cause defects such as gate oxide leakage or gate line bridging in the semiconductor devices, which lowers the yield and reliability of the semiconductor devices. Thus, any contaminants remaining on the membrane 411 and/or the pedestal 310 must be removed by washing the same using deionized water.

However, such contaminants cannot be completely removed by the washing operation performed by the conventional CMP apparatus.

In an attempt to wash the contaminants off of the membrane 411 disposed at the bottom of the polishing head 410, deionized water is sprayed upwards through the fluid ports 314 of the pedestal plate 311. However, the contaminants washed off of the surface of the membrane drop onto the pedestal film 313 as entrained in the deionized water. Also, some of the contaminants are induced into holes 3131 in the pedestal film 313, which holes 3131 are shown in FIG. 6. These holes 3131 have been punched into the film 313 to lower the rigidity thereof and thus lessen the impact on wafers contacting the film 313. Each of the holes 3131 has a diameter of about 2 mm. The contaminants can therefore enter the holes 3131 and are not readily washed away by deionized water sprayed through the first nozzle 331 of the load-cup 300. Hence, the contaminants may dry up over time in the holes 3131 and thereby form particles each having a diameter of about 20 $\mu$m. Both the contaminants entrained in the deionized water remaining on the surface of the pedestal film 313 and the contaminants accumulating in the holes 3131 contact the surface of a wafer loaded onto the CMP apparatus.

In the conventional CMP apparatus, the pedestal film 313 and the wafer contact each other over a wide area because the pedestal film 313 extends over the entire surface of the pedestal plate 311. Accordingly, a comparatively large amount of contaminants are transferred to the wafer surface, i.e., contaminants are transferred to the wafer over practically the entire surface thereof. The contaminants transferred to the wafer surface may produce scratches in the wafer surface during polishing, thereby lowering the yield and reliability of a semiconductor device manufactured from the polished wafer.

SUMMARY OF THE INVENTION

Therefore, an object of the present invention is to provide an improved pedestal of a load-cup which can prevent scratches from being produced on the surface of a wafer by contaminants which remain on the surface of the pedestal.

To achieve the above object, the present invention provides a pedestal of a load-cup of a chemical mechanical polishing (CMP) apparatus, which includes a pedestal plate for supporting the wafer within the load-cup, a pedestal support column for supporting and elevating the pedestal plate, a plurality of fluid ports provided in the pedestal plate for allowing a wafer to be vacuum-chucked to the pedestal and for allowing deionized water to be sprayed from the pedestal, and a pedestal film fixed to the pedestal plate and extending over only a limited area including those areas directly around the of fluid ports.

Preferably, the pedestal film comprises a plurality of annular members each extending around the periphery of a respective one of the plurality of fluid ports. Alternatively, the pedestal film may comprise one or more members extending around a plurality of the fluid ports in a radial direction.

Still further, the pedestal plate may have the shape of a cross or may include an inner cross-shaped part consisting of a central portion and radial arms extending from the central portion, and a peripheral part connecting ends of the radial arms of the inner part remote from the central portion. In either of these cases as well, the pedestal film may comprise annular members extending each around only a respective one of the fluid ports, or one or more members each extending radially around several of the fluid ports.

Accordingly, the contaminants, including slurry debris, which have the potential for scratching the wafer surfaces, can be effectively washed away from the pedestal and/or remain there in only small amounts, whereby a high yield and the reliability of semiconductor devices produced from the wafers can be sustained.

BRIEF DESCRIPTION OF THE DRAWINGS

The above and other objects, features and advantages of the present invention will become more apparent from the following detailed description of the preferred embodiments thereof made with reference to the attached drawings, of which.

DETAILED DESCRIPTION OF THE PREFERRED EMBODIMENTS

Figure 1:
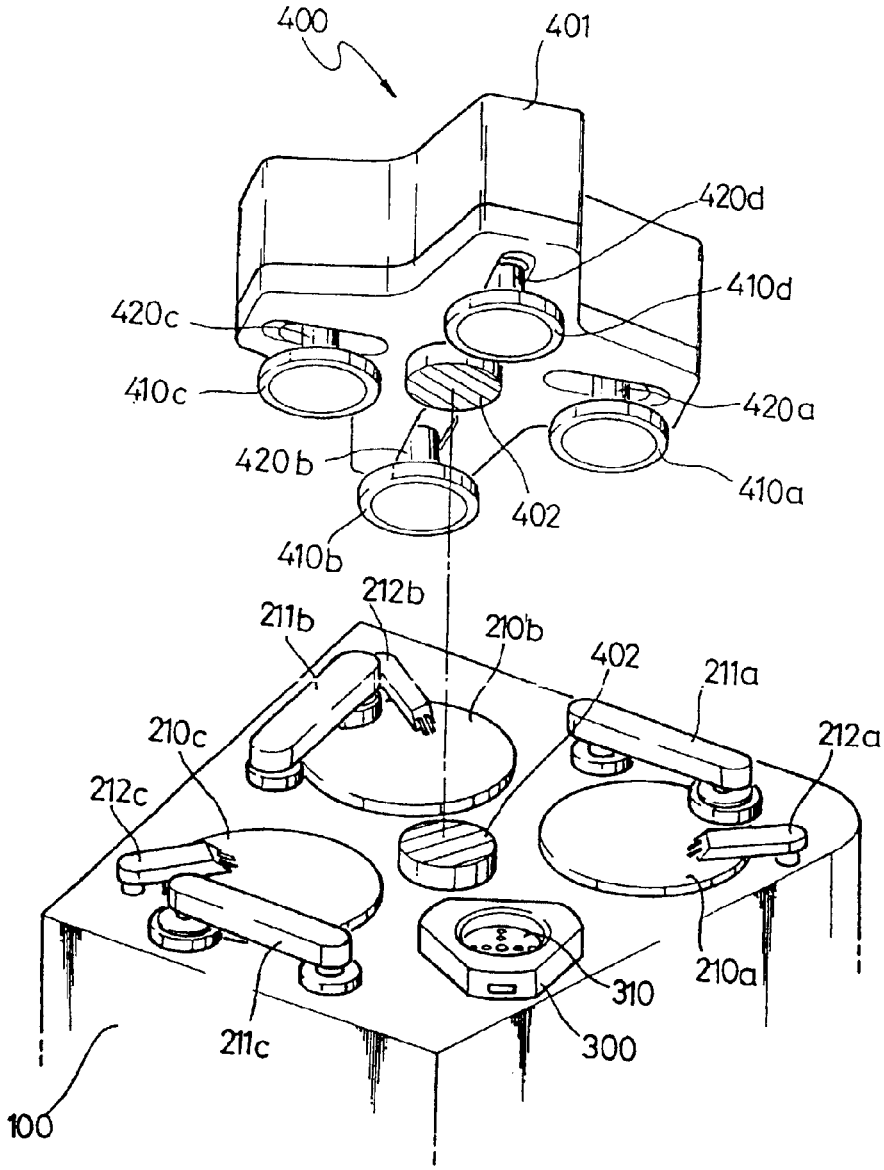
FIG.1 (PRIOR ART)
FIG. 1 is an exploded perspective view of a conventional CMP apparatus.
Figure 2:
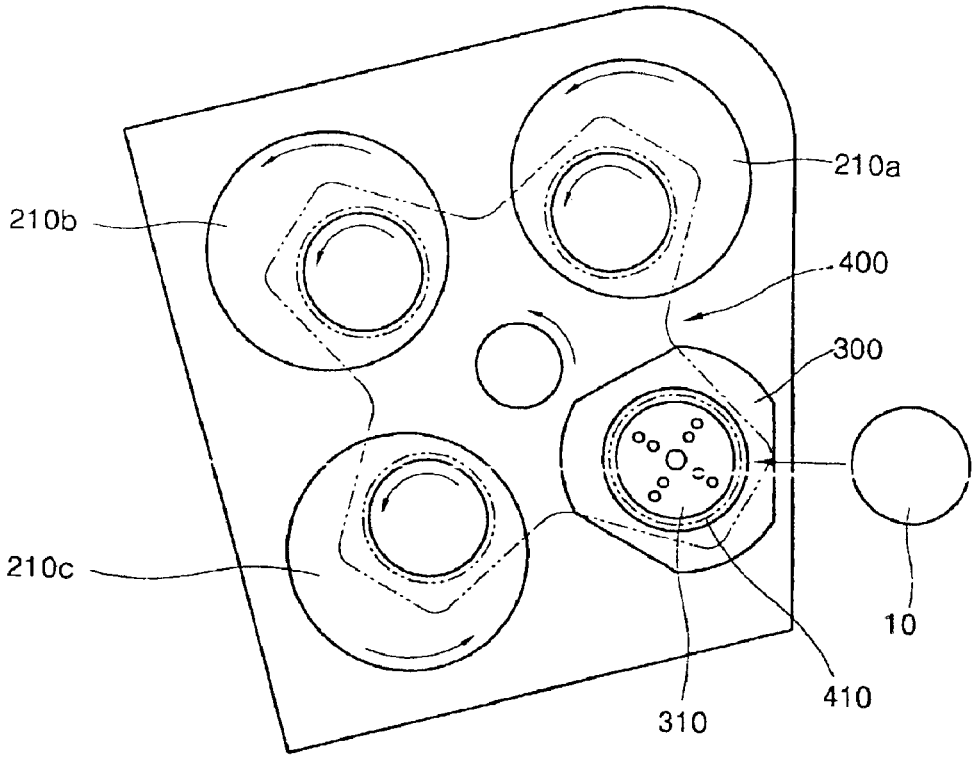
FIG.2 (PRIOR ART)
FIG. 2 is a top view of a bottom part of the conventional CMP apparatus, illustrating the movement of a wafer during polishing.
Figure 3:
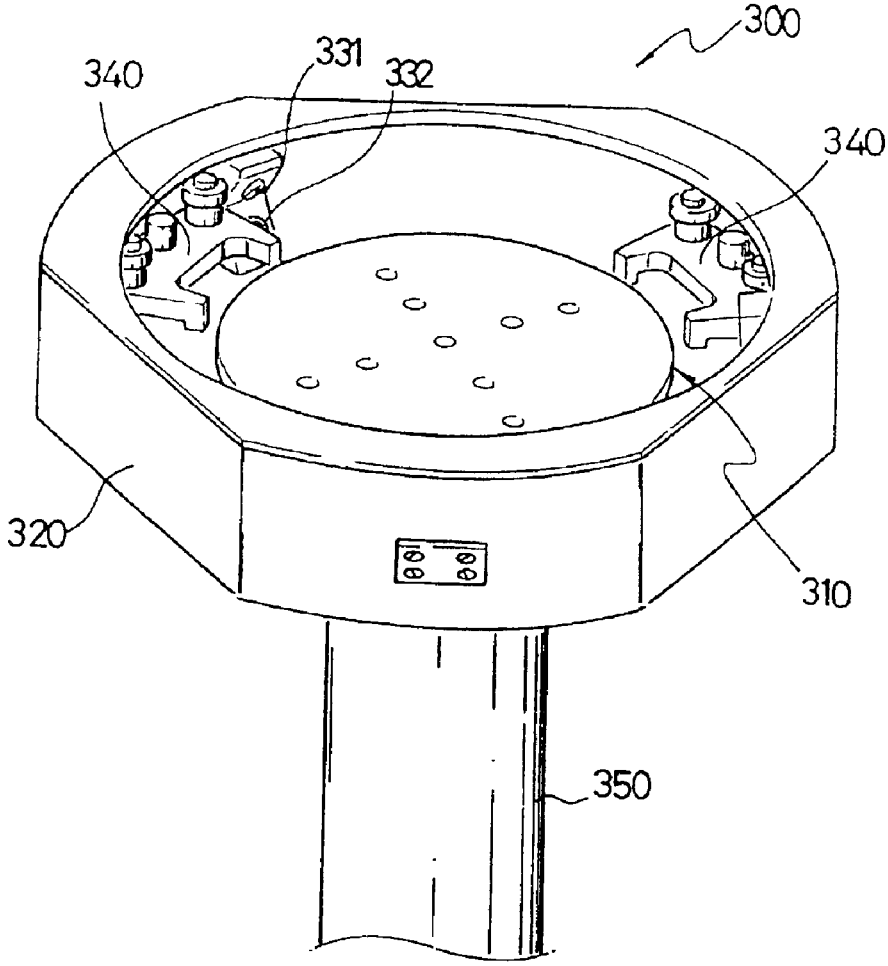
FIG.3 (PRIOR ART)
FIG. 3 is a perspective view of the load-cup of the conventional CMP apparatus.
Figure 4:
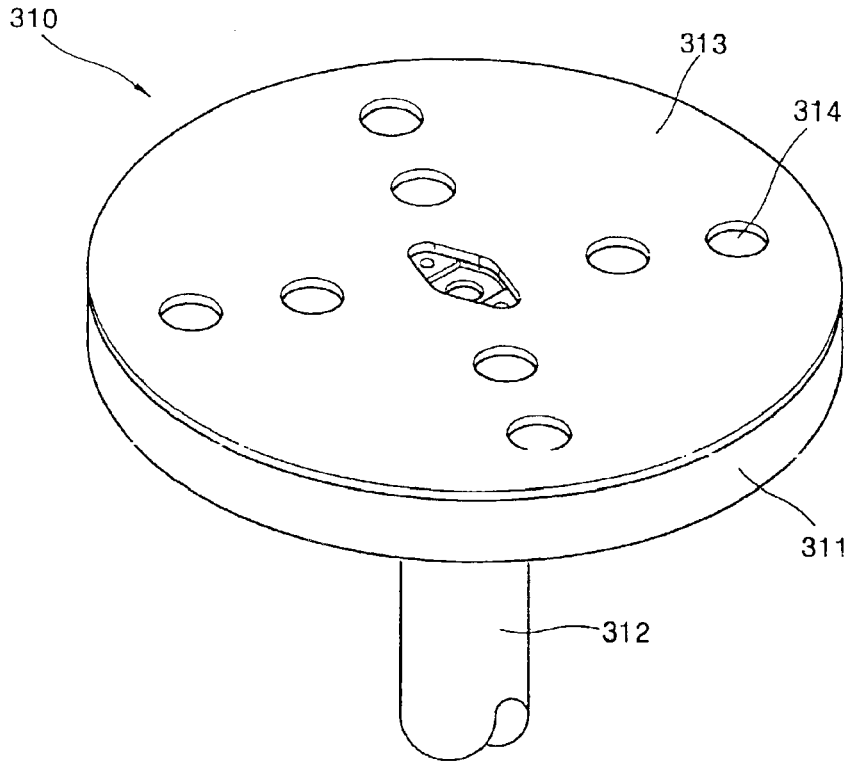
FIG.4 (PRIOR ART)
FIG. 4 is a perspective view of a pedestal of the load-cup.
Figure 5:
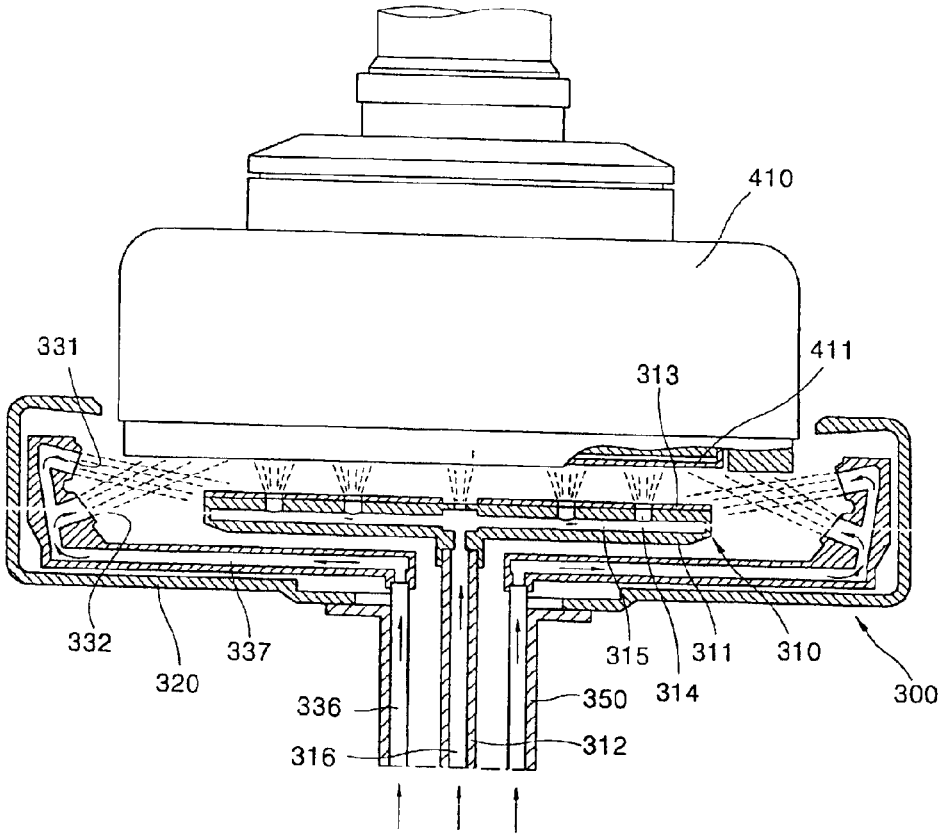
FIG.5 (PRIOR ART)
FIG. 5 is a cross-sectional view of the load-cup, illustrating a state in which the bottom surface of a polishing head and the top face of the pedestal are washed.
Figure 6:
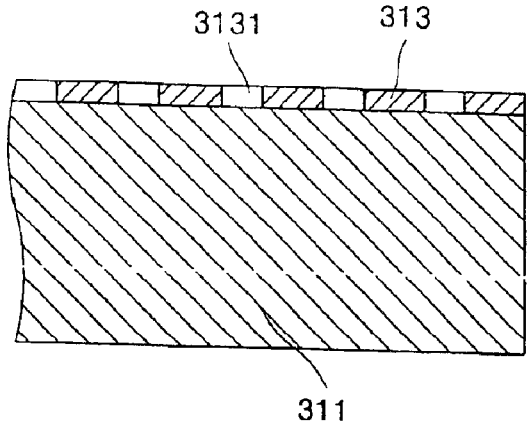
FIG.6 (PRIOR ART)
FIG. 6 is a cross-sectional view of a peripheral portion of the pedestal of the load-cup.
Figure 7:
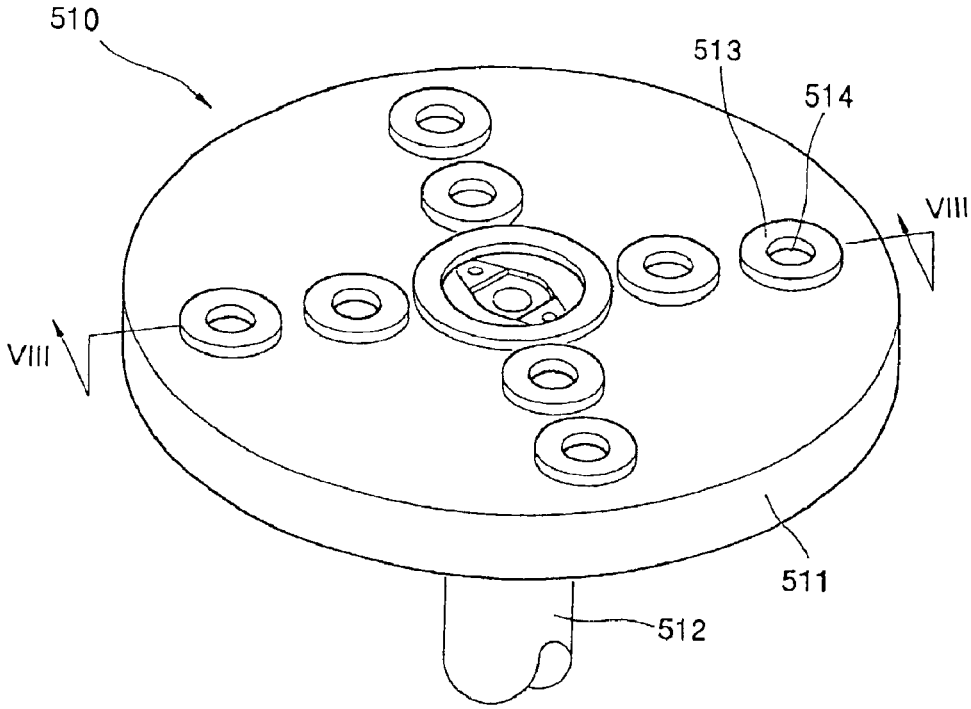
FIG. 7 is a perspective view of a preferred embodiment of a pedestal according to the present invention.
Figure 8:
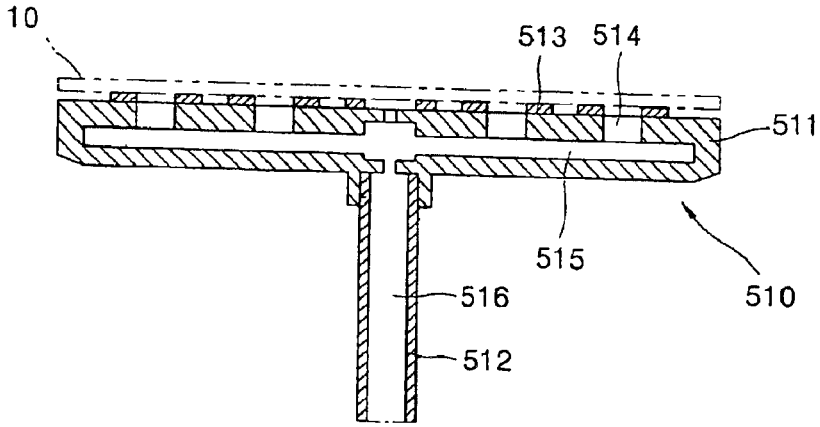
FIG. 8 is a cross-sectional view of the pedestal taken along line VII–VIII in FIG. 7.

Referring first to FIGS. 7 and 8, pedestal 510 of a load-cup of a chemical mechanical polishing (CMP) apparatus according to the present invention includes a pedestal plate 511, a pedestal support column 512 extending from the bottom of the pedestal plate 511, and a pedestal film 513 fixed to the pedestal plate 511 at the top surface thereof.

The pedestal plate 511 supports a wafer 10 in the load-cup and to this end is circular. The pedestal support column 512 supports and elevates the pedestal plate 511. A plurality of fluid ports 514 extend into the plate 511 from the top surface thereof at locations lying along lines extending radially outward from the center of the plate 511. As shown in FIG. 8, a vertical passageway 516 extends through the pedestal support column 512, and a lateral passageway 515 defined within the pedestal plate 511 connects the fluid ports 514 to the vertical passageway 516. The vertical passageway 516 and the lateral passageway 515 allow deionized water to be supplied to the fluid ports 514 for washing a membrane mounted on the bottom of a polishing head of the CMP apparatus. The vertical passageway 516 and the lateral passageway 515 also serve as vacuum lines for allowing a wafer 10 to be vacuum-chucked to the pedestal atop the pedestal film 513.

The pedestal film 513, which directly contacts the surface of the wafer 10, consists of a plurality of annular film members extending around the fluid ports 514, respectively. The pedestal film 513 thus covers only that portion of the pedestal plate 511 which is used to vacuum-chuck the wafer 10. Therefore, the pedestal film 513 minimizes the amount of contact that takes place between the wafer surface and the film 513 itself, i.e., the contact area is significantly less than that provided by the conventional pedestal.

Figure 9:
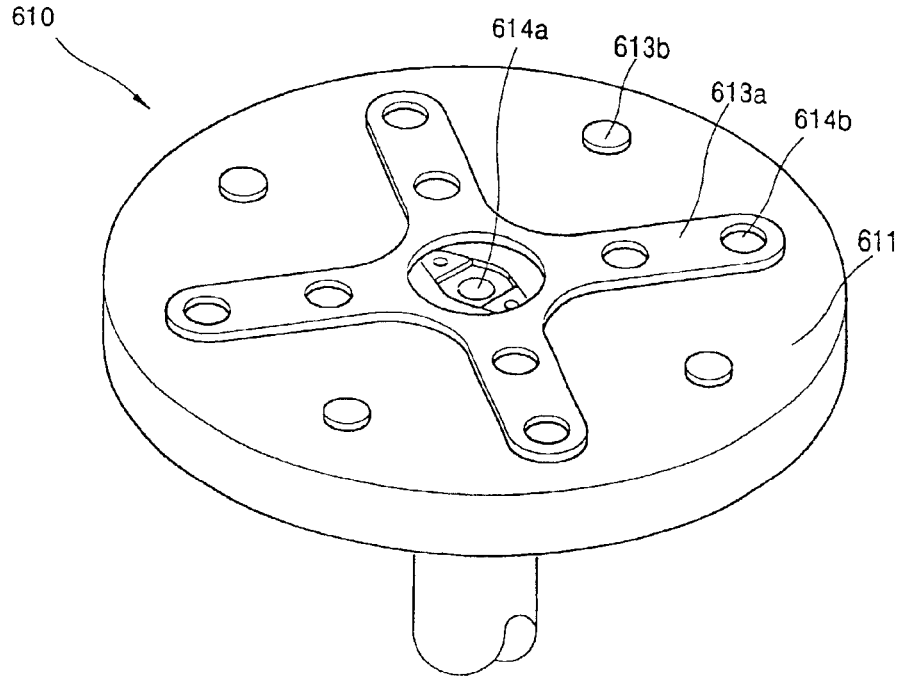
FIGS. 9 through 14 are perspective views of other embodiments of a pedestal according to the present invention.
Figure 10:
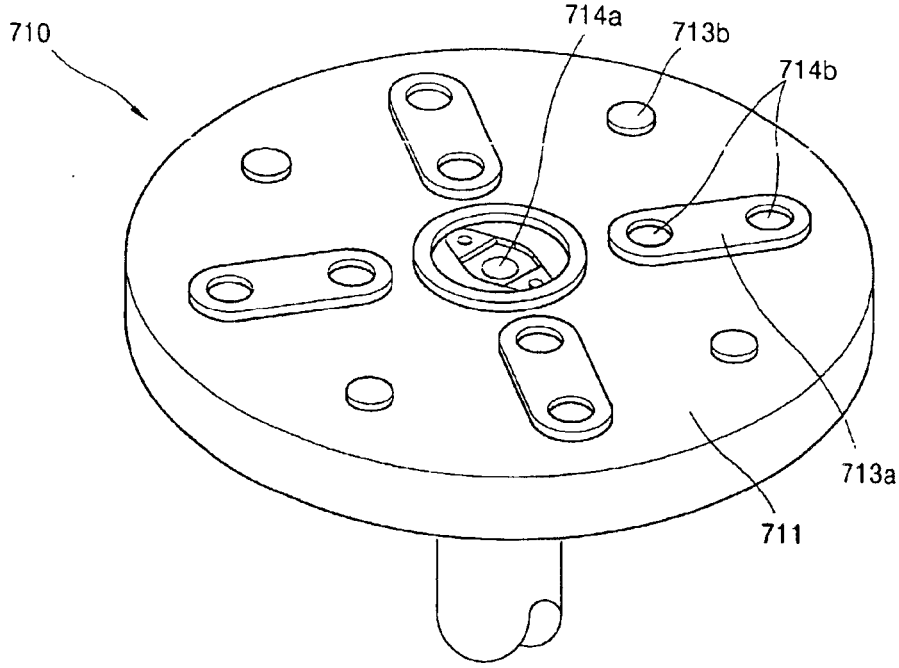

FIGS. 9 and 10 illustrate other embodiments of pedestals 610 and 710 according to the present invention. In the embodiment of FIG. 9, the pedestal 610 has a pedestal film 613*a* in the form of a cross. Specifically, the pedestal film extends contiguously around the fluid port 614*a* formed at the center of the pedestal plate 611 and around the fluid ports 614*b* which are disposed radially outward from the central fluid port 614*a*. The pedestal film 713*a* of the embodiment of FIG. 10, on the other hand, consists of an annular film member extending around the central fluid port 714*a* and a plurality of film members each extending contiguously around those fluid ports 714*b* which lie along the same respective line extending radially outward from the central port 714*a*.

These pedestal films 613*a* and 713*a* also offer relatively small areas of contact with the wafer surface.

In the case where the wafer is large, discrete pedestal film members 613*b* and 713*b* may be provided at equal angular intervals about the outer peripheries of the pedestal plates 611 and 711 so as to support the peripheral portion of the wafer, whereby the wafers are stably supported by the film members 613*a*/713*a* which extend basically only around the fluid ports and the discrete peripheral film members 613*b*/713*b*.

Because the pedestal film member are provided over a limited area consisting of the area directly around the fluid ports, i.e., the area at which the vacuum-chucking of the wafer takes place, and any additional area needed for stably supporting the wafer, the contact area between the pedestal film and the wafer surface is minimal. Thus, the amount of contaminants remaining on the surface of the pedestal film or accumulating in the holes in the pedestal film is relatively small and hence, only a small amount of contaminants has the potential for being transferred to the wafer surface.

Figure 11:
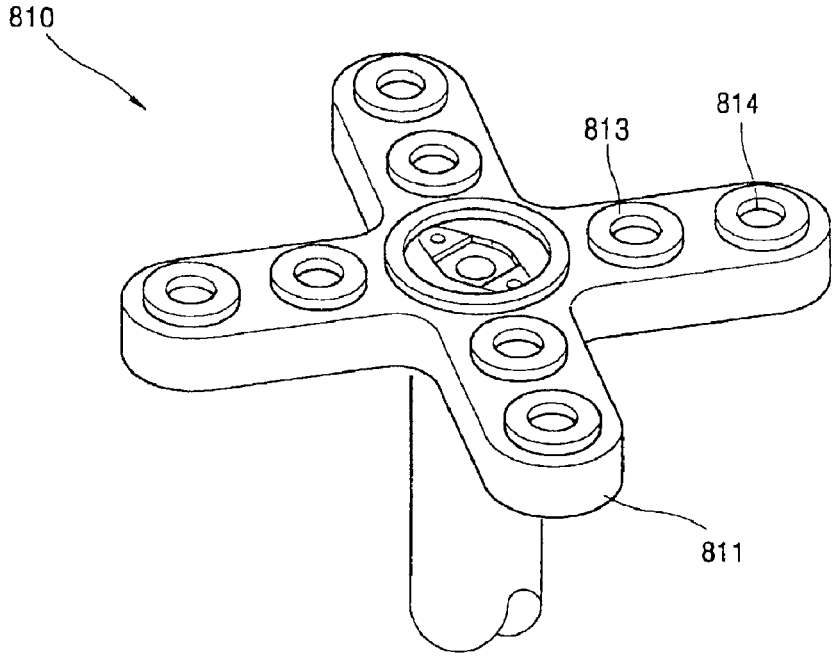
Figure 12:
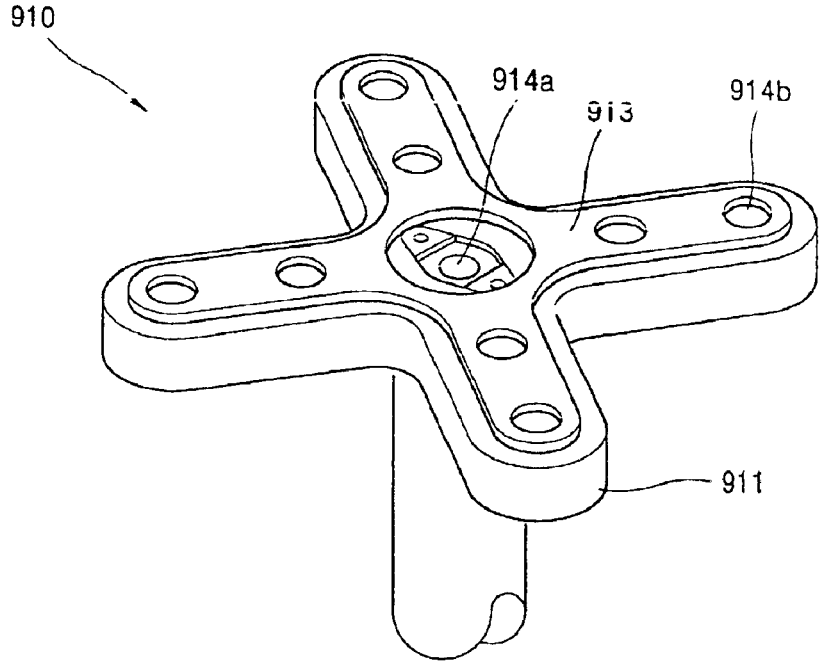
Figure 13:
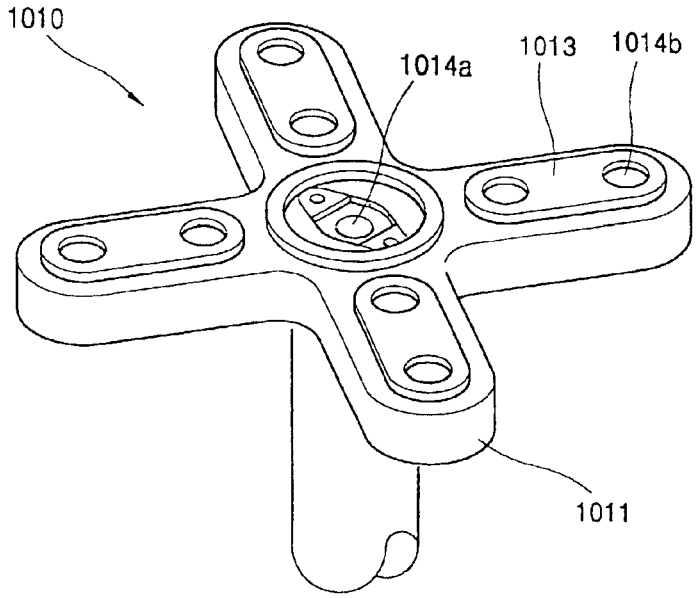

FIGS. 11–13 shows still other embodiments of a pedestal according to the present invention.

In each of these embodiments, the pedestal 810/910/1010 includes a pedestal plate 811/911/1011 having the shape of a cross, and a plurality of fluid ports 814 extending through the top surface of the plate 811/911/1011 at the center thereof and at the radial arms thereof.

Therefore, the pedestal plates 811/911/1011 each has a minimal top surface. Thus, only a very small amount of deionized water containing contaminants can remain on the pedestal plate, whereby the amount of contaminants which could be potentially transferred to the wafer surface is minimized.

In the embodiment of FIG. 11, the pedestal film 813 consists of annular film members each extending around a respective one of the fluid ports 814. The pedestal film 813 offers a smaller contact area to the wafer surface compared to the pedestal film of the conventional CMP apparatus.

In the embodiment of FIG. 12, the pedestal film 913 extends contiguously around the central fluid port 914*a* and around the fluid ports 914*b* in the radial arms of the pedestal plate 911. In the embodiment of FIG. 13, the pedestal film 1013 consists of an annular film member extending around the central fluid port 1014*a* and a plurality of radial film members each extending contiguously around those fluid ports 1014*b* in a respective radial arm of the pedestal plate 1011.

The pedestal films 913 and 1013 of these embodiments also offer considerably less contact area to the wafer than the pedestal film of the conventional CMP apparatus.

Figure 14:
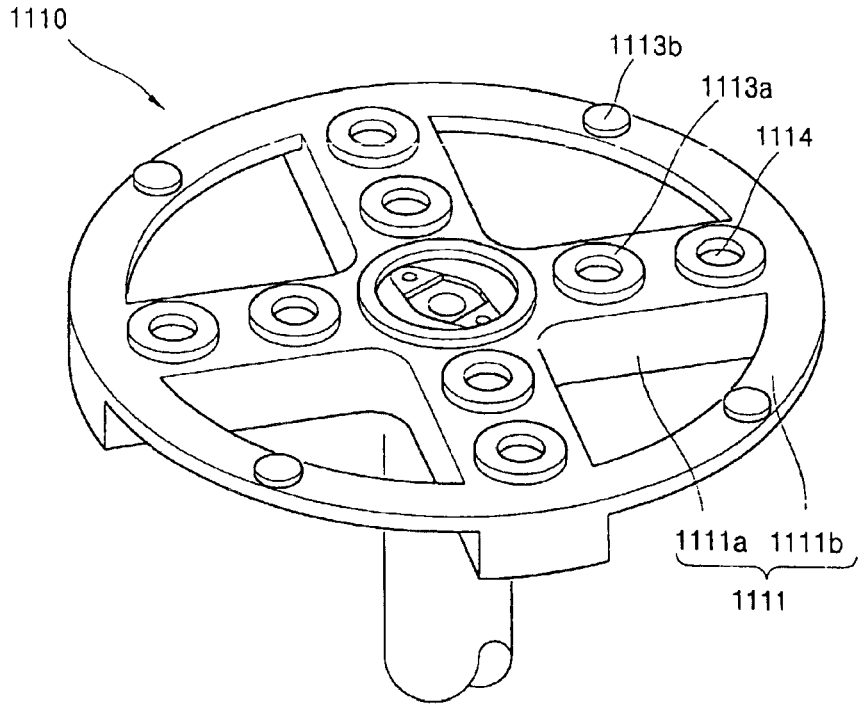

In the embodiment of FIG. 14, the pedestal 1110 includes a pedestal plate 1111 having a cross-shaped inner part 1111*a* and an annular peripheral part 1111*b* connecting ends of the radially arms of the cross-shaped inner part 1111*a*. A plurality of fluid ports 1114 are disposed along the cross-shaped inner part 1111*a* and annular pedestal film members 1113*a* extend around the fluid ports 1114. Discrete pedestal film members 1113*b* are preferably fixed to the peripheral part 1111*b* of the pedestal plate as spaced from one another therealong at uniform intervals. As alternatives to what is shown in FIG. 14, the pedestal film on the cross-shaped inner part 1111*a* may comprise the contiguous cross-shaped pedestal film member of the embodiment of FIG. 12 or the separate pedestal film members of the embodiment of FIG. 13.

In any of these cases, the pedestal 1110 of the embodiment FIG. 14 is suitable when the wafer and the pedestal plate 1111 are both large, because in this embodiment the peripheral portion of the wafer is supported in a more stable manner. In addition to this advantage, the embodiment of FIG. 14 possesses all of those advantages described above in connection with the embodiments of FIGS. 12–14.

Thus, according to the present invention, the contact area between a wafer and a pedestal film is minimal, thereby minimizing the amount of contaminants which can be potentially transferred from the pedestal to the surface of the wafer when the pedestal and the wafer come into direct contact. Thus, the present invention suppresses the amount of scratches on the wafer due to contaminants, which in turn reduces defects in a semiconductor device, caused by the scratches, thereby improving the yield and reliability of the semiconductor devices.

Finally, although the present invention has been described with reference to specific embodiments thereof, various changes in form and detail will become apparent to those skilled in the art. Therefore, all such changes are within the true spirit and scope of the invention as defined by the appended claims.

What is claimed is:

1. A pedestal of a load-cup for supporting a wafer as it is loaded/unloaded onto/from a chemical mechanical polishing (CMP) apparatus, the pedestal comprising:

a pedestal plate dedicated to support a wafer;

a pedestal support column extending from the bottom of and supporting said pedestal plate; and a pedestal film fixed to the upper surface of said pedestal plate;

said pedestal support column having a vertical passageway extending therein, said pedestal plate having a plurality of fluid ports extending through said upper surface, and an internal passageway extending therein and connecting said fluid ports to the vertical passageway in said pedestal support column, and said pedestal film extending over only a portion of the entire upper surface of said pedestal plate, which portion include areas each extending completely around said fluid ports such that said film comprises at least one film member extending completely around said fluid ports, and said pedestal film offering an area of contact for a wafer supported thereon that is substantially less than the area of the upper surface of the pedestal plate.

2. The pedestal of a load-cup according to claim 1, wherein the at least one film members of said pedestal film comprises a plurality of annular members each extending around a respective one of said fluid ports.

3. The pedestal of a load-cup according to claim 1, wherein said fluid ports lie along each of several lines extending radially outwardly from a central portion of the top surface of said pedestal plate, and the at least one film member of said pedestal film includes at least one member extending contiguously around the fluid ports lying along at least one of said lines.

4. The pedestal of a load-cup according to claim 1, wherein said fluid ports include a central fluid port located at a central portion of the top surface of said pedestal plate, and peripheral fluid ports lying along each of several lines extending radially outwardly from said central portion, and the at least one film member of said pedestal film comprises a central annular film member extending around said central fluid port, and radially extending film members discrete from said central film member and each extending around a plurality of the fluid ports which lie along a respective one of said lines.

* * * * *